US006544070B1

(12) United States Patent
Radliff

(10) Patent No.: US 6,544,070 B1
(45) Date of Patent: Apr. 8, 2003

(54) ENCLOSURE FOR SPLICED CABLE HAVING IMPROVED HINGE ASSEMBLY

(75) Inventor: David Ray Radliff, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/630,163

(22) Filed: Aug. 1, 2000

(51) Int. Cl.[7] ..... H01R 13/40
(52) U.S. Cl. ..... 439/596; 439/467
(58) Field of Search ..... 439/596, 467, 439/31, 595, 696, 687; 16/271, 225; 220/4.23; 174/92, 91, 93

(56) References Cited

U.S. PATENT DOCUMENTS 5,395,248 A * 3/1995 Kinoshita et al. ..... 439/31
5,561,269 A * 10/1996 Robertson et al. ..... 174/92
5,606,150 A 2/1997 Radliff et al. ..... 174/92
6,325,671 B1 * 12/2001 Radliff ..... 439/610

* cited by examiner

*Primary Examiner*—P. Austin Bradley
*Assistant Examiner*—Ross Gushi

(57) ABSTRACT

A splicing enclosure is comprised of a base portion and a lid portion, with a grounding contact positioned in both halves. The grounding contacts include a plurality of grounding contact portions to receive shielded cable in a transverse relation thereto. The enclosure is provided with a removable ferrule, which can be slidably received between the shielding and inner sheath of a shielded cable to enhance the strain relief on the cable between the cable and the grounding contact. The grounding contact is designed so as to accommodate a plurality of shielded cable configurations. The enclosure is also provided with a progressive latch, which cooperates upon rotation of the lid relative to its base portion to take off the load from the integrated hinge to prevent breakage of the hinge.

22 Claims, 10 Drawing Sheets

ENCLOSURE FOR SPLICED CABLE HAVING IMPROVED HINGE ASSEMBLY

FIELD OF THE INVENTION

The present invention relates to the field of electrical connections and more particularly to enclosures for spliced cable connections such as telephone wires.

BACKGROUND OF THE INVENTION

It is common in the telephone industry, where cable splices need to be made along the path of distribution, that splices be made which will include some type of an electrical connection to splice the individual wires of the cable and environmentally seal them in a connection enclosure to prevent degradation to the connection. This type of splice could be either a so-called drop wire splice or could be a buried splice in the case of underground cable. It is also common to have either two or six pairs of twisted wire, which comprise the telephone cable.

As in almost any enclosure, it is requisite that the enclosure be latched together in a fixed relation. This is required for several reasons. First the contact system between the commoning of the ground may be degraded if the enclosure is not fully closed. Secondly, the strain relief system, if based upon the full closure, may also be degraded if not properly closed. And finally, most systems are sealed with a gel or grease which must be contained within the enclosure.

One such device is shown in the Tyco Electronics (AMP Division) commercial product known as the CERTI-SEAL Wire Splice Enclosure (for 2- to 6-pair buried drop wire splice) where the housing is formed as a shell of two similar halves, where the enclosure is defined by two housing halves integrally joined at a hinged seam. The edges of the halves also include snap latches which snap together when the two housing halves are fully closed. Splice connection blocks known as TEL-SPLICE (also a commercial of Tyco Electronics) then interconnect the individual wires to one another for making the individual wire splices. One of the shortcomings of this system is that the only retention between the housing halves is through the hinges, which by necessity is somewhat weak, due to its inherent need to be flexible. If this hinge were to break, then the alignment of the two housing halves is difficult to replicate, as there is now no connection between the housing halves. The gel or grease within the enclosure causes the two halves to float relative to each other, making it difficult to latch.

SUMMARY OF THE INVENTION

The objects of the invention have been accomplished by providing an electrical connector of the type for interconnecting at least two wires, comprising an enclosure having at least two housing parts hinged together along one edge thereof. The hinged side edge further comprises a latch assembly comprised of a projection and a complementary receiving opening, whereupon the projection rotates into the opening upon closure of the housing parts, retaining the two housing parts together.

In the preferred embodiment of the invention, the projection is profiled as an arcuately shaped wall, which rotates into the opening. The arcuately shaped wall has an inner surface facing the hinged side edge, and the opening is elongate and has a surface contoured to receive the inner surface. The arcuately shaped wall also has a rigidifying rib extending from one of the housing parts, interconnecting the inner surface with the one housing part. Preferably, the elongate opening is T-shaped to include a portion of the opening to receive the rigidifying rib. Also preferably, the one conductive contact member is positioned in at least one housing part to make electrical contact with a conductor of a cable upon closure, the arcuately shaped wall being profiled to engage the inner surface and remove load from the hinge, prior to the conductive contact making contact with the cable.

In another aspect of the invention, an electrical connector enclosure has two housing parts, which rotate relative to each other along a first side edge thereof. The housing parts having a latch assembly comprised of an arcuate latching member positioned on a first housing part which cooperates with a complementary surface on the second housing part, upon relative rotation therebetween, and progressively transfers load from the first side edge to the latch assembly upon closure thereof.

In the preferred embodiment, the two housing parts are integrally connected along the first side edge, and the arcuate latching member is defined by an arcuately shaped projection, which is slidably received under, and engages against, the complementary surface. Preferably, the complementary surface is positioned on an opening, which cooperates with the projection. Also preferably, the arcuately shaped projection is an elongate wall that curves towards the first side edge. The arcuate shaped projection has a rigidifying rib, which extends between the arcuately shaped projection and the housing part. The opening is T-shaped to include an elongate opening portion to receive the arcuately shaped projection and a transverse portion, which receives the rib. The latch assembly is positioned proximate the first side edge, and the connector includes a second snap latch latching assembly on a second side edge opposite the first side.

In yet another embodiment of the invention, an electrical connector housing comprises two housing parts which rotate relative to each other along a hinged side edge, the two housing parts each having an upper face which, when closed, abut each other. One of the housing parts includes an arcuately shaped projection positioned on the upper face proximate to, and extending substantially parallel to, the hinged side edge. The arcuately shaped projection curves towards the hinged side edge and extends along a radius of curvature defined by a radius equal to the radial distance of the arcuately shaped projection to the hinged side edge. The housing also includes an opening profiled to receive the arcuately shaped projection.

In the preferred embodiment, the projection is profiled as an arcuately shaped wall, which rotates into the opening. The arcuately shaped wall has an inner surface facing the hinged side edge, and the opening is elongate and has a surface contoured to receive the inner surface. The arcuately shaped wall has a rigidifying rib extending from one of the housing parts, interconnecting the inner surface with the one housing part. The elongate opening is T-shaped to include a portion of the opening to receive the rigidifying rib. The connector has at least one conductive contact member positioned in at least one housing part to make electrical contact with a conductor of a cable upon closure, and the other housing part has a cable receiving section for receiving said cable. The arcuately shaped wall is profiled to engage the inner surface and begins to transfer load from the hinge, prior to the conductive contact making contact with the cable.

The preferred embodiment of the invention will now be described by way of reference to the following drawings.

DETAILED DESCRIPTION OF THE PREFERRED EMBODIMENT

Figure 1:
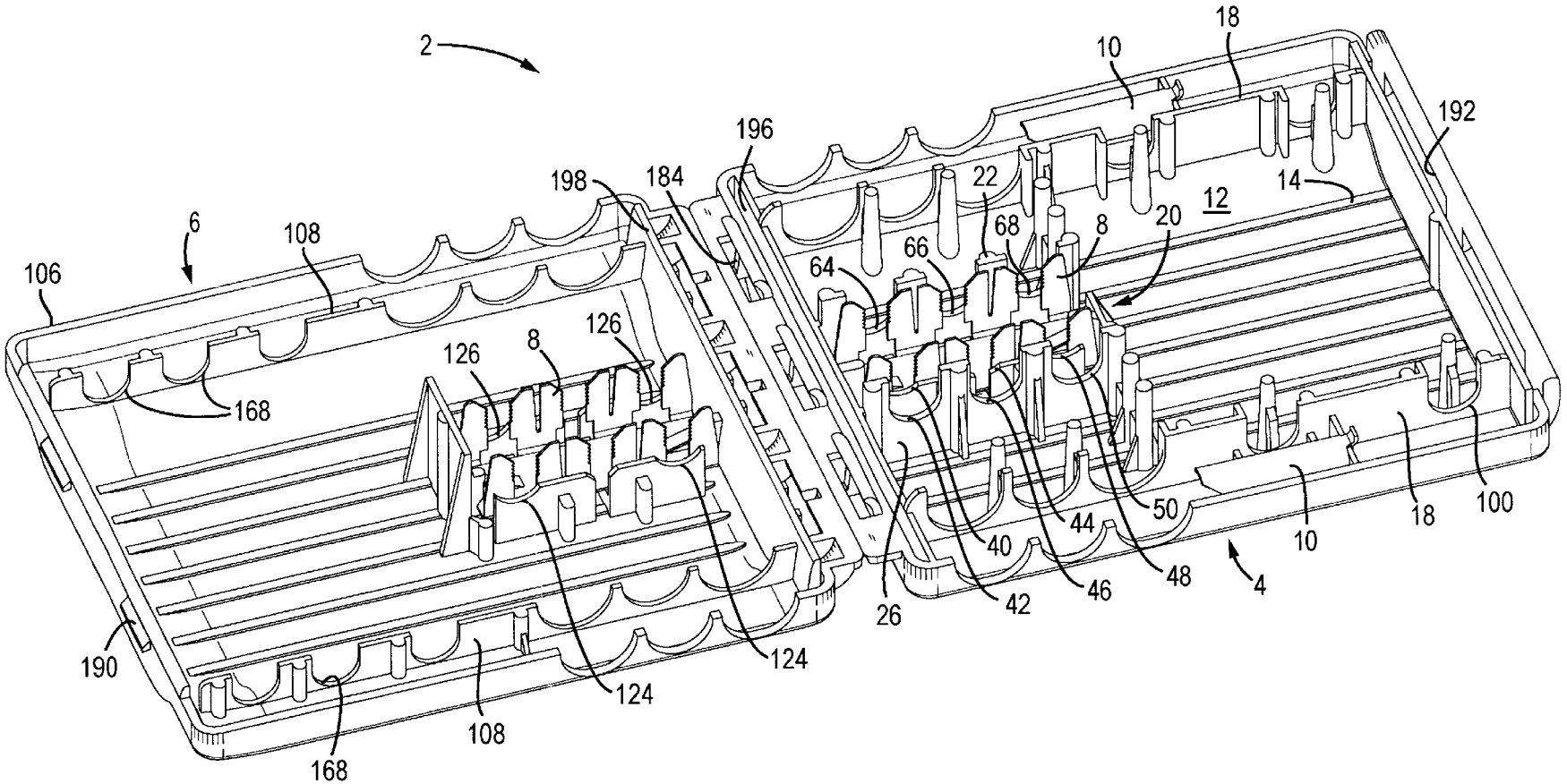
FIG. 1 is an isometric view of the subject enclosure in the open state.
Figure 2:
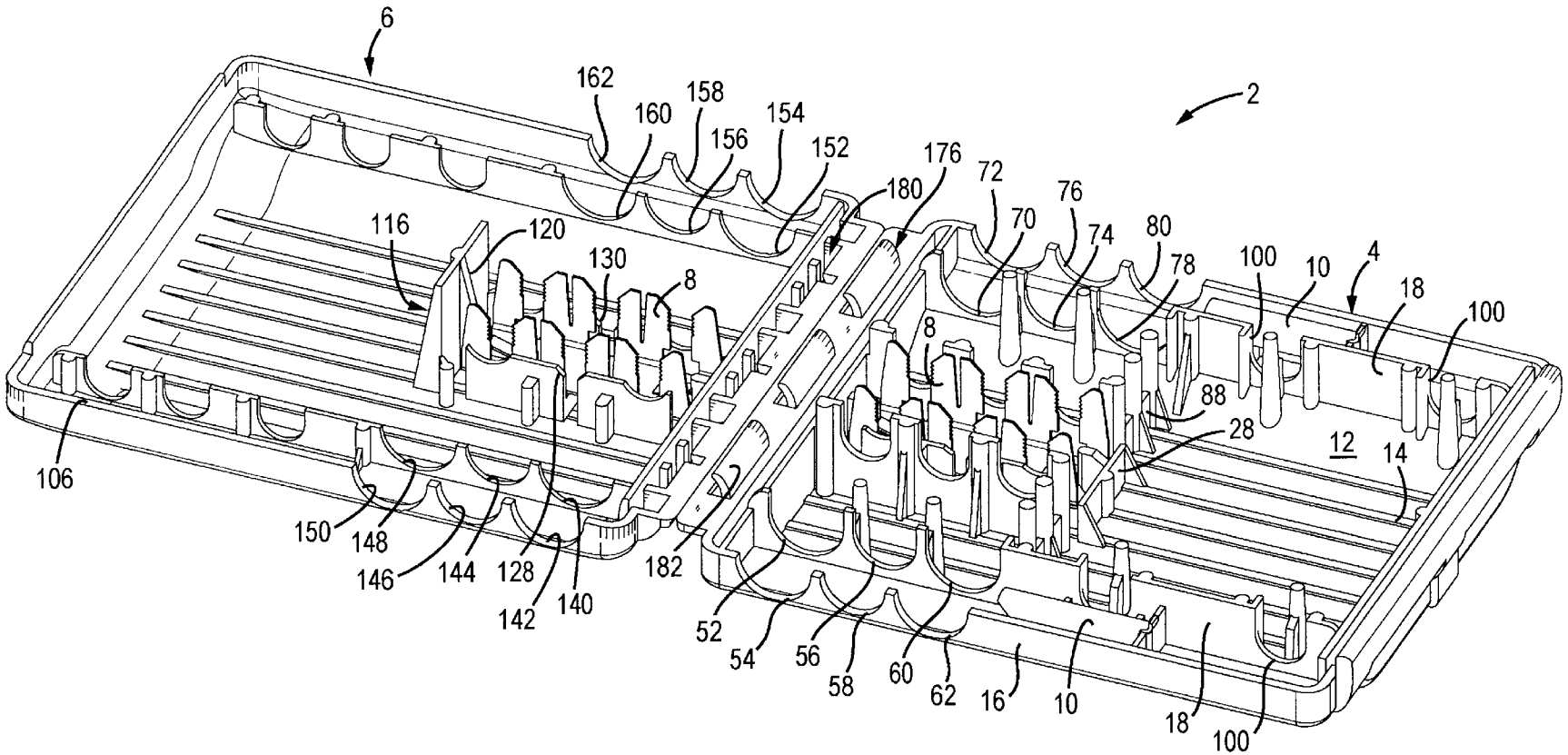
FIG. 2 is an isometric view similar to that of FIG. 1 taken from a different perspective.
Figure 3:
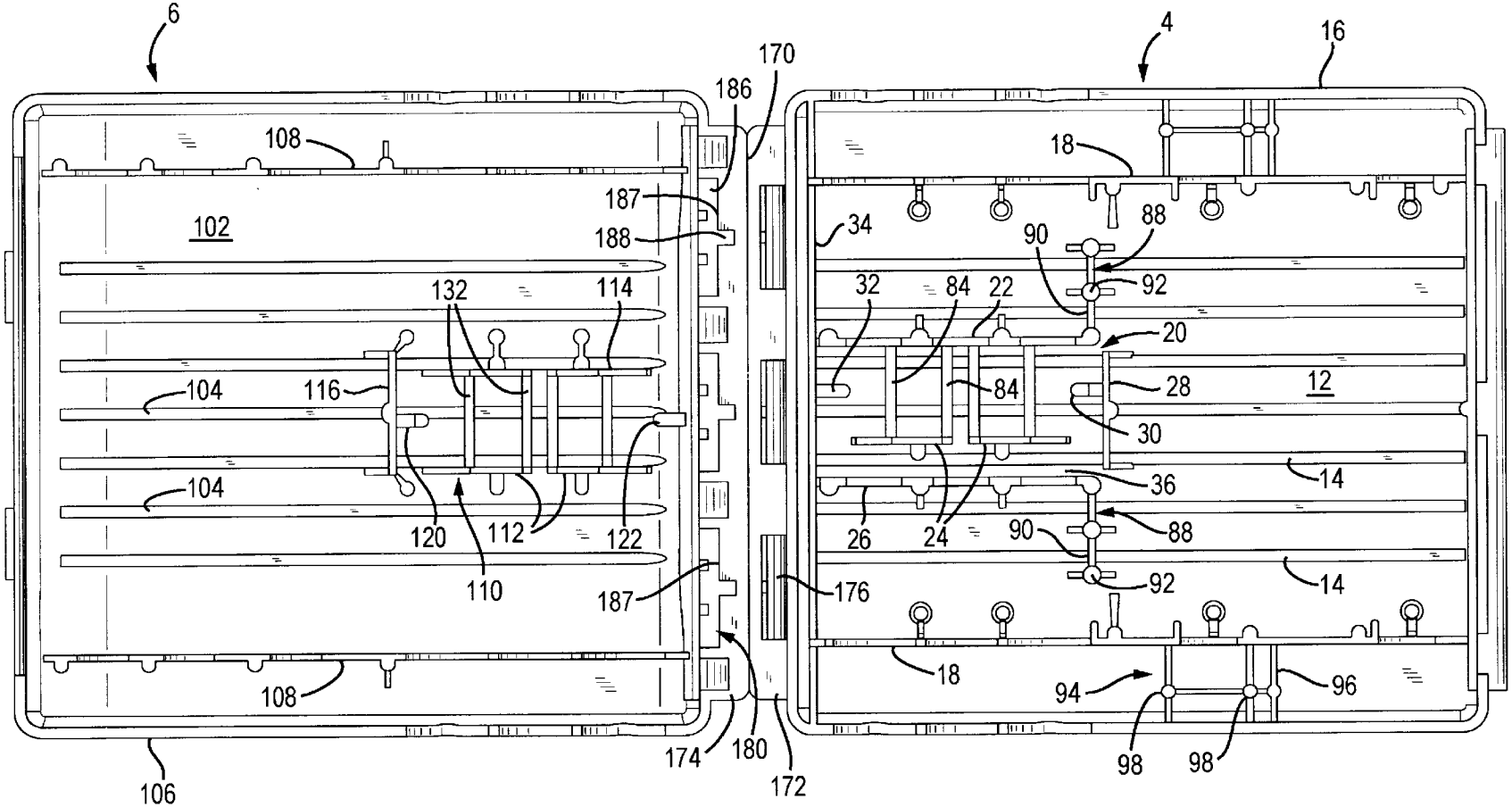
FIG. 3 is an upper plan view of the enclosure housing of FIG. 1 or 2 with the grounding contacts removed.

With respect first to FIGS. 1 and 2, the invention will be described in greater detail. As shown, a splicing enclosure is shown generally as reference 2, which incorporates a housing comprised of a first housing portion, or base portion 4, and a second housing portion or lid 6. The enclosure 2 further comprises grounding contact members shown at 8, which common the shielding of spliced shielded cables as will be described in further detail. Finally, the enclosure 2 includes removable strain relief ferrules 10, which as shown in FIGS. 1 and 2, are shown in a stored position. With reference now to FIGS. 1 through 3, the housing member comprised of first and second housing portions 4 and 6 will be described in greater detail.

With respect first to FIG. 3, the base portion 4 is comprised of a base wall 12 provided with a plurality of strengthening ribs shown at 14. The base wall 12 includes an outer peripheral wall 16, which forms the concavity of the enclosure and further includes two spaced-apart and opposing walls at 18. The base portion 4 further includes a receiving nest 20 to receive the associated grounding contact 8 as shown in FIGS. 1 and 2. As shown best in FIG. 3, the nest 20 is comprised of a first wall 22, intermediate walls 24, and an outer wall 26. The nest 20 is bounded on its inner end by an upstanding wall at 28 as best shown in FIG. 2 or 3. As also best viewed in FIG. 3, locking ribs 30 and 32 project upwardly to form locking surfaces for the grounding contact as will be described in greater detail. Locking rib 30 extends integrally upwardly from both the base wall 12 and the wall 28. Locking rib 32 extends upwardly from the base member 12 and integrally from an inner surface 34 of the peripheral wall 16.

As shown in FIG. 3, walls 24 and 26 are disposed in a parallel relation to each other and define a gap 36 therebetween. It should also be appreciated that the walls 24 and 26 are profiled to receive cables transversely thereof, see particularly FIG. 1 with contoured surfaces 40, 42; 44, 46; and 48, 50. It should also be appreciated that the opposing wall 18 and peripheral wall 16 are also profiled to receive a cable transversely therethrough, as shown in FIG. 2, the opposing wall 18 and peripheral wall 16 include openings 52, 54; 56, 58; and 60, 62, as shown in FIG. 2. It should be appreciated that in comparing FIGS. 1 and 2, the pair of openings 52, 54 are aligned with the openings 40, 42; the openings 56, 58 are aligned with the openings 44, 46, and that the openings 60, 62 are aligned with the respective openings 48, 50. It should also be appreciated that the openings 52, 54; 40, 42; and 60, 62; 48, 50 are profiled to receive the same sized cable, and in the preferred embodiment of the invention are sized to receive a 12-pair shielded cable. As shown in FIG. 1, wall 22 also includes contoured surfaces to allow for a cable entrance, and includes surfaces 64, 66, and 68. With reference now to FIG. 2, contoured surfaces 70–80 are provided in walls 16 and 18 which are aligned with the surfaces 64, 66, and 68, that is, surfaces 70 and 72 are aligned with surface 64; surfaces 74, 76 are aligned with surface 66; and surfaces 78, 80 are aligned with surface 68. As shown best in FIG. 3, a support for the contact 8 is formed by a plurality of transversely extending ribs 84 extending intermediate the walls 22, 24. Finally, support walls 88 provide structural rigidity to the contact nest 28 and include a transverse wall portion 90 and a plurality of upstanding posts at 92. As shown in FIG. 3, a ferrule storage area is shown at 94 having an upstanding wall at 96 and upstanding posts at 98. The opposing walls 18 further comprise gel relief ports at 100, as shown in FIG. 1.

With respect to FIG. 3, the lid 6 includes a base wall 102 having structural ribs at 104. The lid 6 further includes a peripheral wall at 106 and opposing walls at 108. Upstanding walls 112 and 114, together with end wall 116, provide a secondary contact-receiving nest 110. In a like manner as the contact receiving nest 20, contact receiving nest 110 further includes retaining ribs 120 and 122 (FIG. 3); contoured surfaces 124, 126, 128, and 130 (FIGS. 1 and 2); and transversely extending ribs 132. As also shown in FIGS. 1 and 2, the outer peripheral wall 106 and the opposing wall 108 further include cable-receiving openings similar to items 52–62, and 70–80. As shown in FIG. 2, openings 140, 142 cooperate with openings 52, 54; openings 144, 146 cooperate with openings 56, 58; and openings 148 and 150 cooperate with openings 60, 62, to complete the cable receiving openings. Similarly, openings 152, 154 cooperate with openings 70, 72; openings 156, 158 cooperate with openings 74, 76; and openings 160, 162 cooperate with openings 78, 80. The opposing walls 108 further comprise gel relief ports at 168, as shown in FIG. 1).

With respect again to FIGS. 1 through 3, the housing portions 4 and 6 are shown as integrally molded about their edges, that is, about a hinge 170 formed between support walls 172 and 174. An edge latching system is comprised of projections 176 and complementary openings 180, as best shown in FIG. 2. Each of the projections 176 includes a curved wall portion 182 (FIG. 2) and an upstanding support rib 184 (FIG. 1). Each of the openings 180 is comprised of a Tshaped slot including an elongate portion 186 and a transverse portion at 188 (FIG. 3). It should be appreciated that each of the projections 176 is receivable in sliding engagement with a corresponding opening 180 as will be further described herein.

Figure 5:
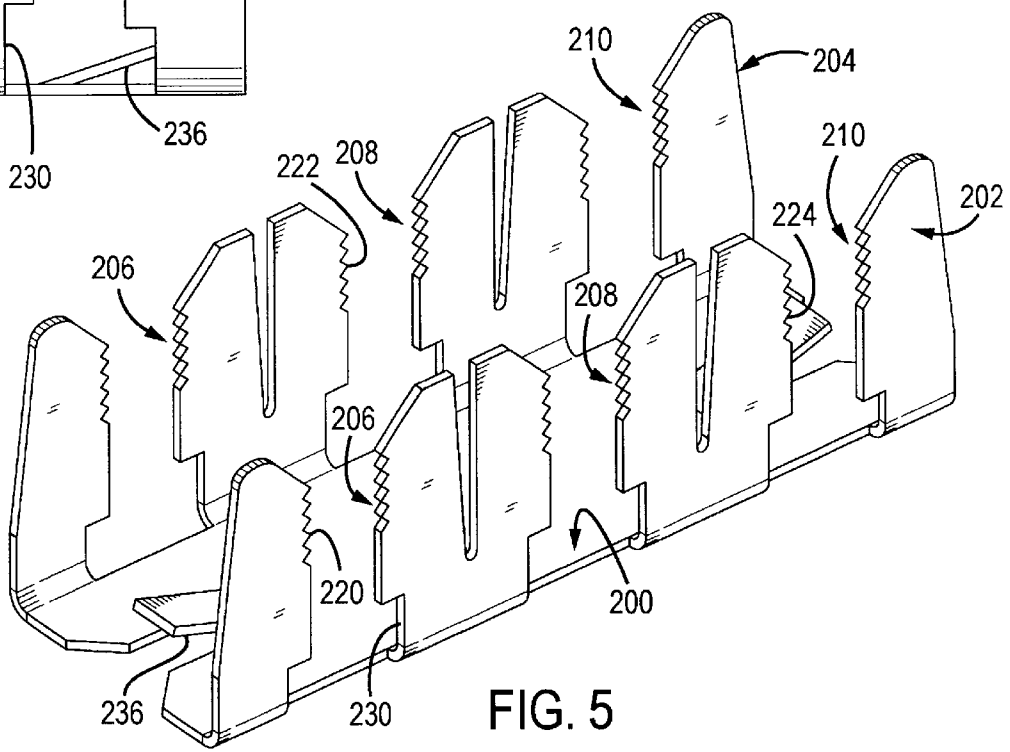
FIG. 5 is an isometric view of the grounding contact of FIG. 4.
Figure 4:
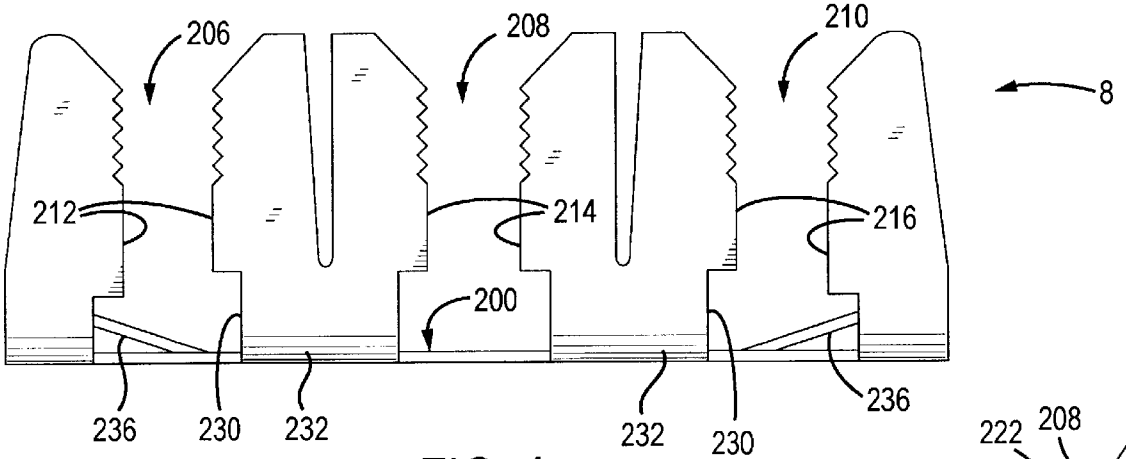
FIG. 4 is a side plan view of the grounding contact shown in FIG. 1 or 2.

With respect now to FIGS. 4 and 5, the grounding contact 8 will be described in greater detail. The contact 8 is comprised of a base portion 200 having generally upstanding wall sections at 202 and 204. The wall sections 202 and 204 define a plurality of grounding contact portions at 206, 208, and 210. Each of the contact portions 206–210 is comprised of side edges 212, 214, and 216, respectively, having serrated edges at 220, 222, and 224. Also with respect to FIG. 4, due to the cut-out sections 230, the base portion 200 of the contacts 8 are bendable at 232, at both ends as will be described in greater detail herein. Finally, as shown in FIGS. 4 and 5, the contact member 8 includes a locking lance 236 which has been struck from the base portion 200 to lock the contact in place in the housing as will also be described in greater detail herein.

Figure 6A:
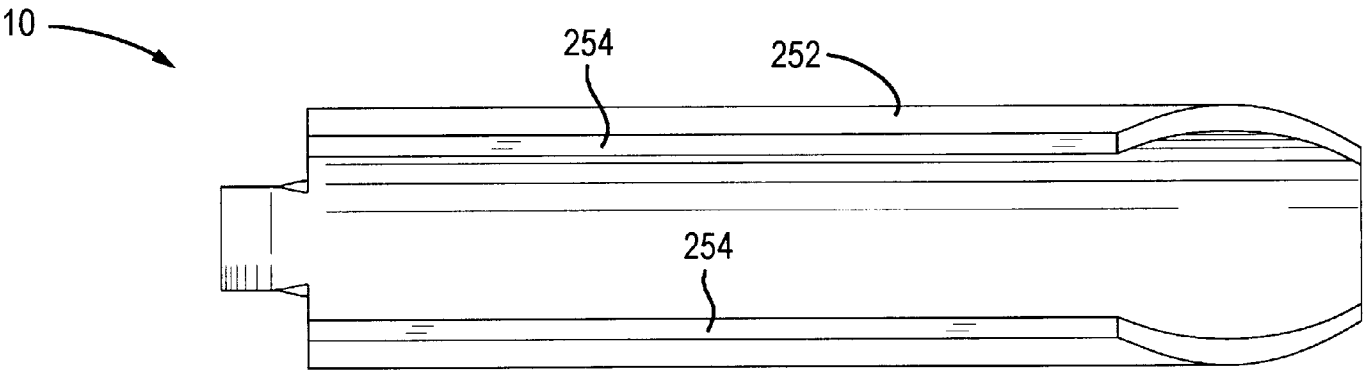
FIG. 6A is an upper plan view of the strain relief ferrule utilized in the subject invention.
Figure 6B:
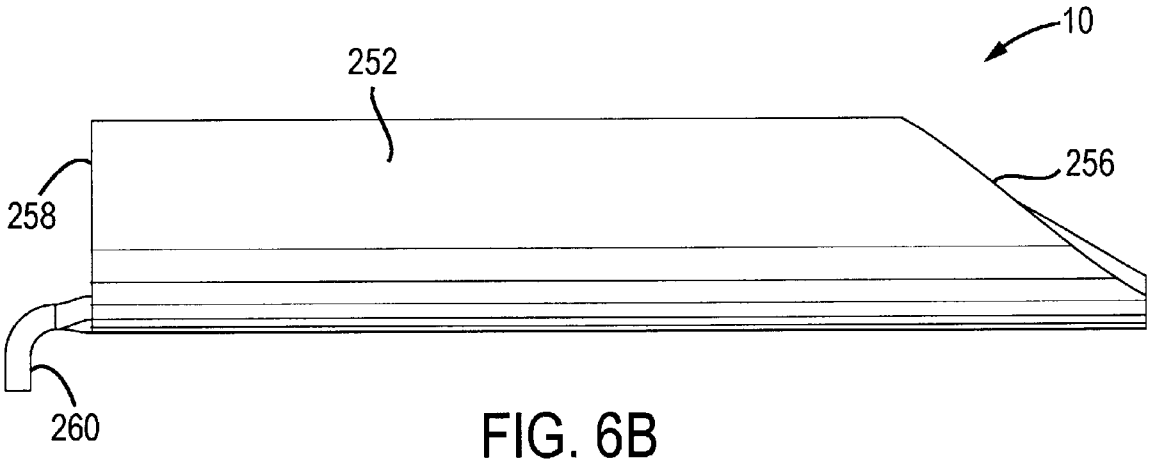
FIG. 6B is a side plan view of the strain relief ferrule of FIG. 6A.
Figure 6C:
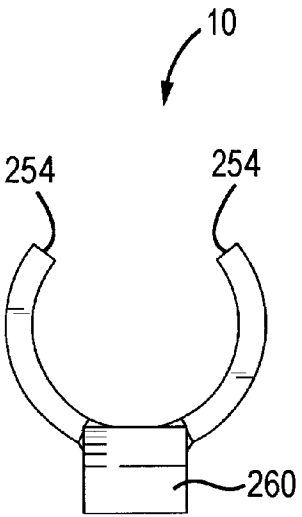
FIG. 6C is an end view of the strain relief ferrule of either of FIG. 6A or 6B.

With respect now to FIGS. 6A and 6C, the ferrule 10 is disclosed as including a substantially cylindrical barrel portion 252 formed from rolling to include top edges at 254. The ferrule 10 further includes a front leading edge at 256 and a rear edge at 258. A gripping tab 260 extends integrally from the rear edge 258 as will be described in further detail.

Figure 7:
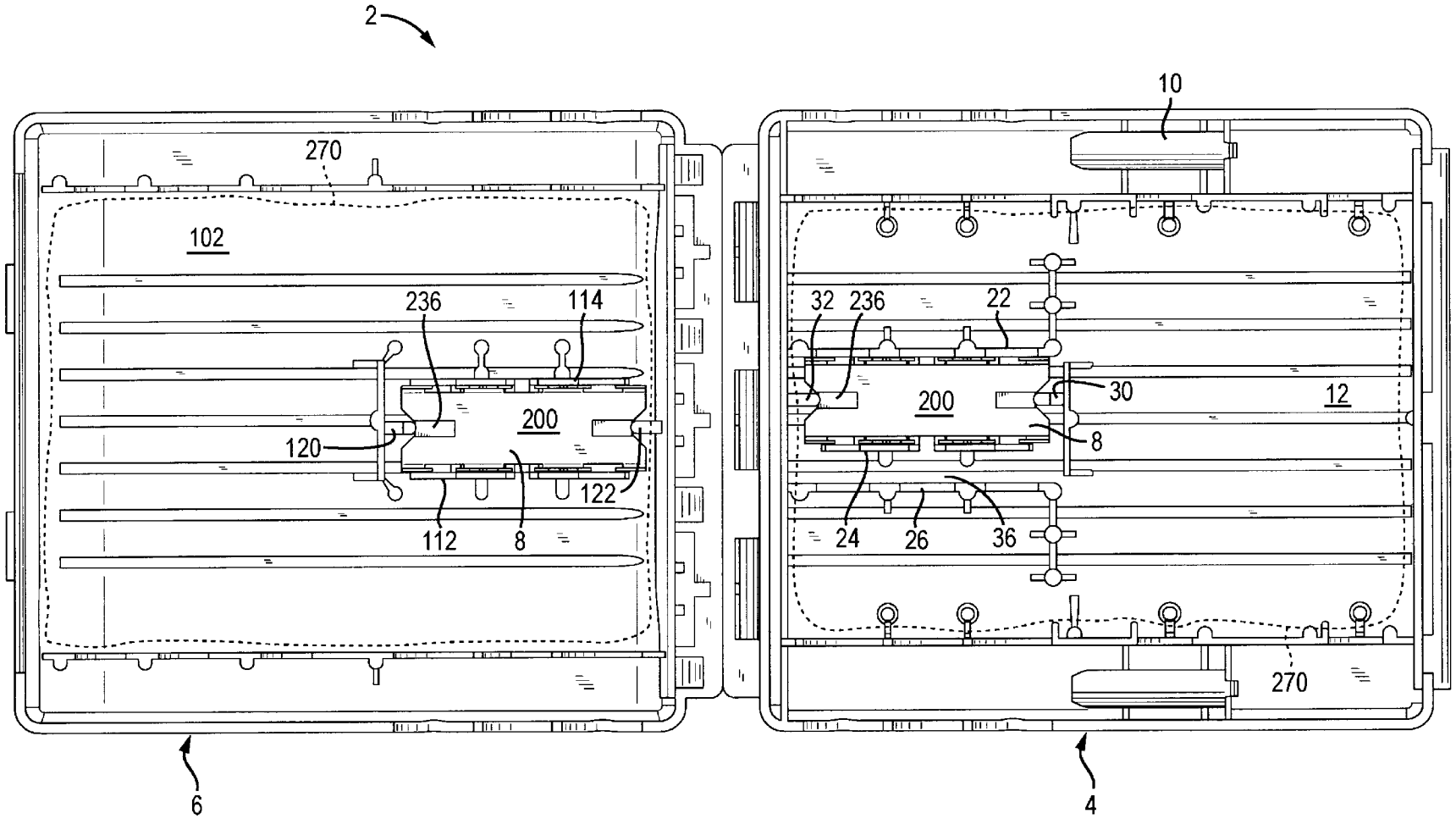
FIG. 7 is an upper plan view similar to that of FIG. 3 showing the grounding contacts in position.

With the components described with respect to FIGS. 1 through 6, the assembly of the apparatus will be described with greater detail. With reference to both FIGS. 3 and 7, the grounding contacts 8 are positioned between respective walls 22 and 24; and 112, 114. The contacts 8 are inserted into their respective positions such that the base portions 200 of the grounding contacts 8 contact the transverse wall portions 84 and 132 of the respective receiving nests. This places the locking lances 236 in locking engagement with the respective ribs 30, 32; 120, 122. It should also be noted that a grease or gel 270 can also be placed in and around the base and lid as shown at 270, and can be placed in the unit prior to the termination of the various cables, or could be injected afterwards.

Figure 8:
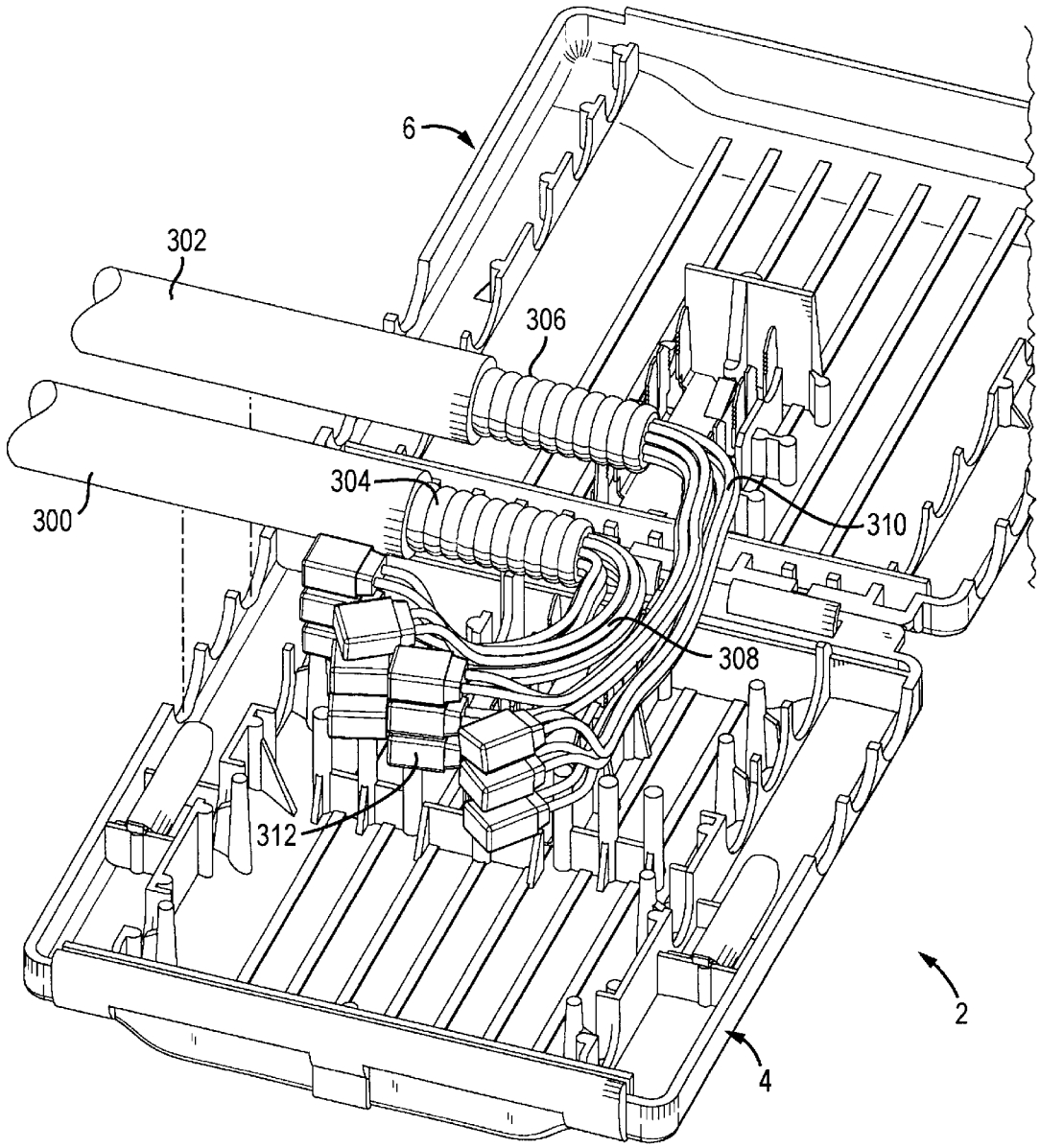
FIG. 8 is a perspective view of the enclosure illustrating two 12-pair cables spliced together, poised for receipt in the enclosure.
Figure 9:
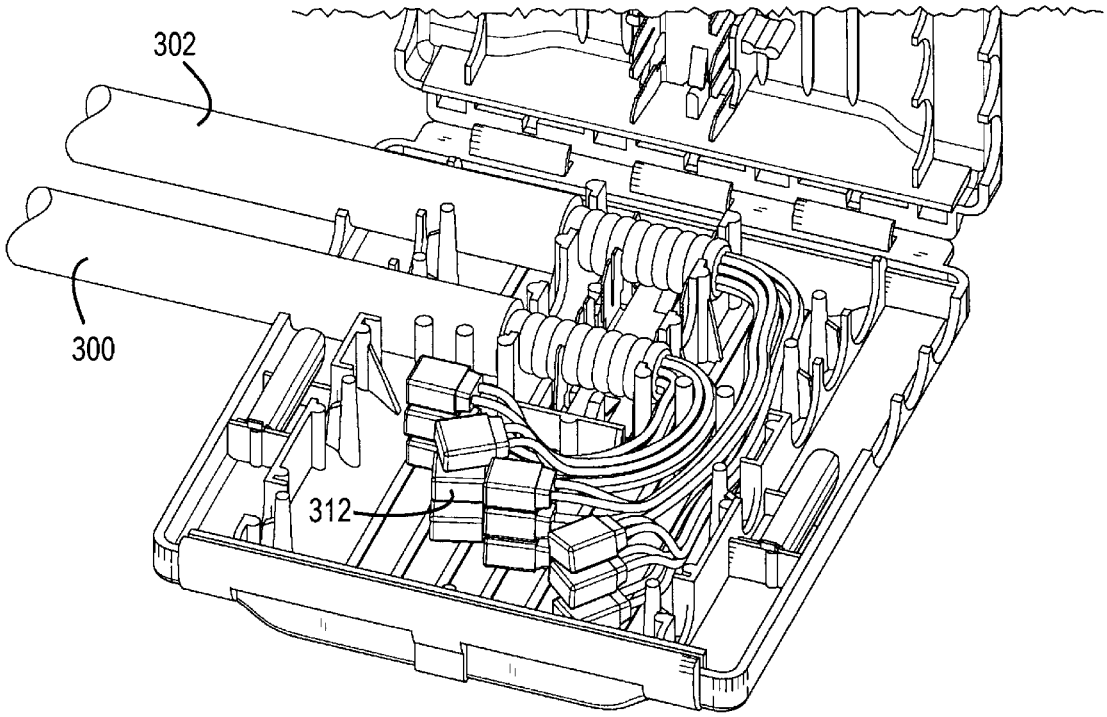
FIG. 9 shows the configuration of two 12-pair cables in a butt splice configuration.
Figure 10:
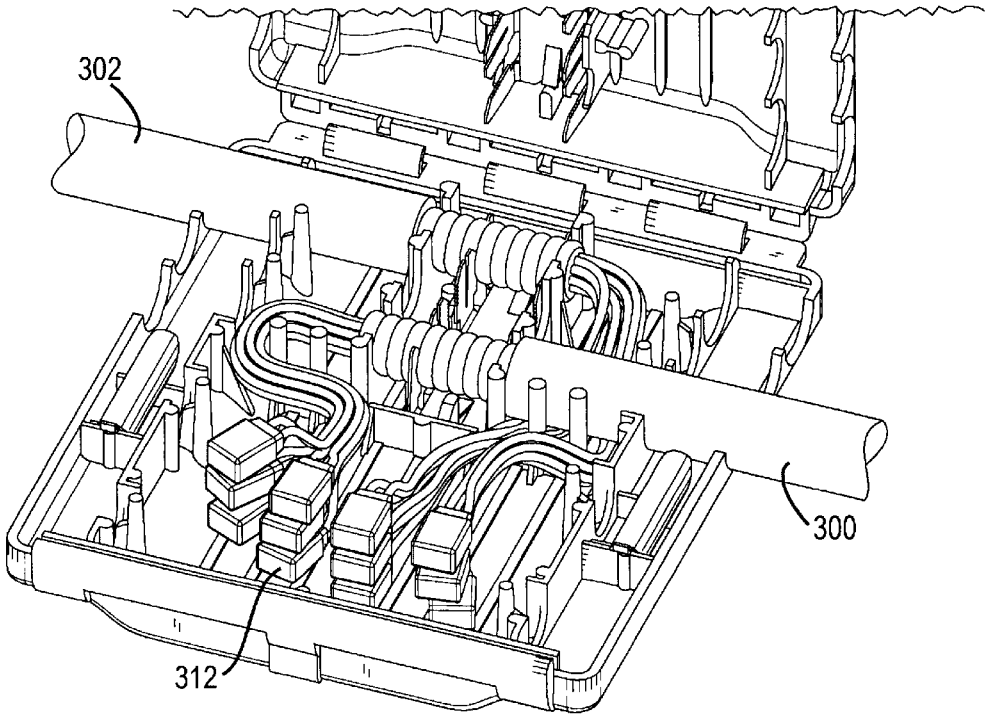
FIG. 10 shows two 12-pair cables in an in-line configuration.
Figure 11:
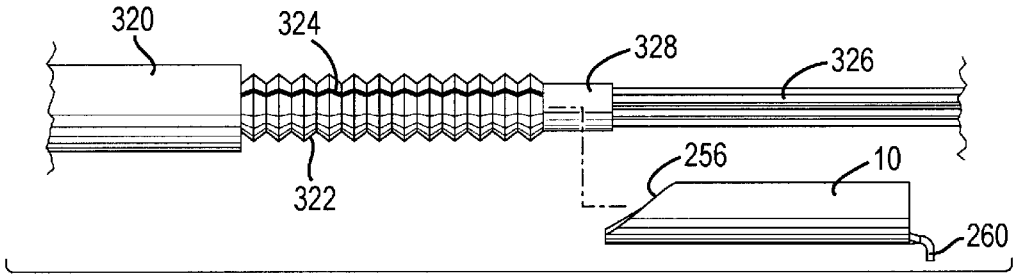
FIG. 11 shows the incorporation of the strain relief ferrule with a 6-pair cable.
Figure 12:
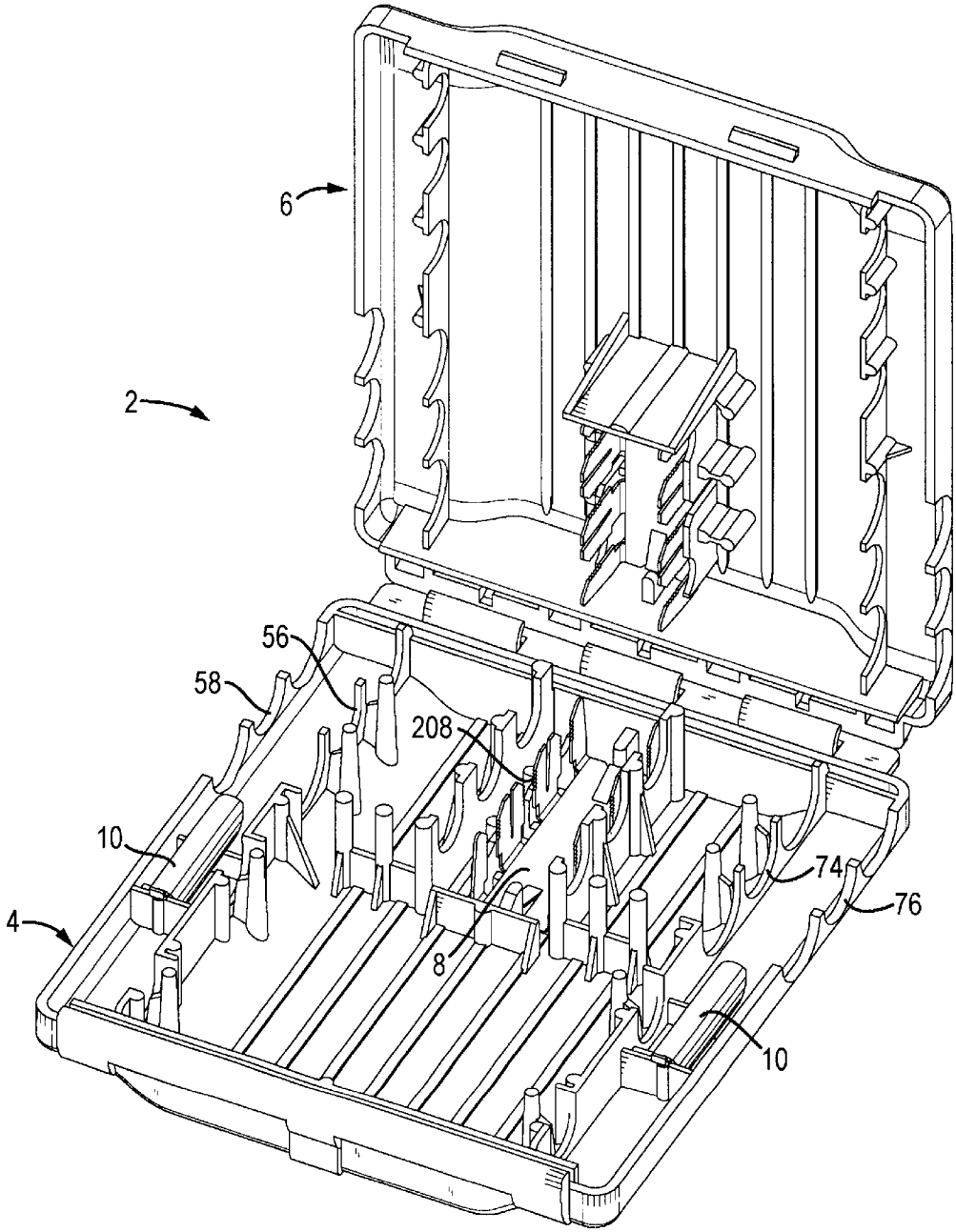
FIG. 12 shows a perspective view of the enclosure for use with the 6-pair cable.

With respect now to FIG. 8, the application of the enclosure 2 as a splicing member will be described. As shown in FIG. 8, the enclosure can be used to splice two cables 300, 302 where each of the cables includes an inner shielding 304, 306, which shields individual twisted pair conductors 308, 310. As shown, the cables 300 and 302 have been terminated by a plurality of electrical splicing connectors such as 312, which could be the TEL-SPLICE connectors as described above. As shown in FIG. 8, cables 300 and 302 are shown as 12-pair cables, and as such, will be positioned in grounding contact portions 206 and 210 (FIGS. 4 & 5) as will be further described herein. As shown in FIG. 9, the layout of the grounding contact allows for the splicing of the cable to be in a butt splice arrangement, as well as an in-line configuration as shown in FIG. 10. With respect now to FIGS. 11 and 12, in the event that a smaller cable, for example, a 6-pair shielded cable is to be spliced, such as a cable shown at 320, the cable is prepared by stripping the insulation back a sufficient portion to expose a length of the shielding sheath 322 for a length similar in length to the strain relief ferrule 10. As shown in FIG. 11, this is accomplished by exposing a portion of the inner shielding 328, with the individual twisted pair of conductors 326 extending therefrom. The seam 324 of the shield can be opened to receive the ferrule 10 therein. As the ferrule has a leading edge portion, the ferrule can be grasped by the tab 260, for example, by a pair of pliers, and can be slidably received so as to be positioned between the shield 322 and the inner sheath 328. The ferrule 10 rigidifies the cable diameter and can now be received in a transverse relation, similar to that shown in FIGS. 9 and 10, but can be received in the center grounding contact portion 208 of the grounding contact 8, or in either of the contact portions 206, 210. Thus, the 6-pair cable 320 would be positioned either in openings 56, 58, or 74, 76 (FIG. 2).

Figure 13A:
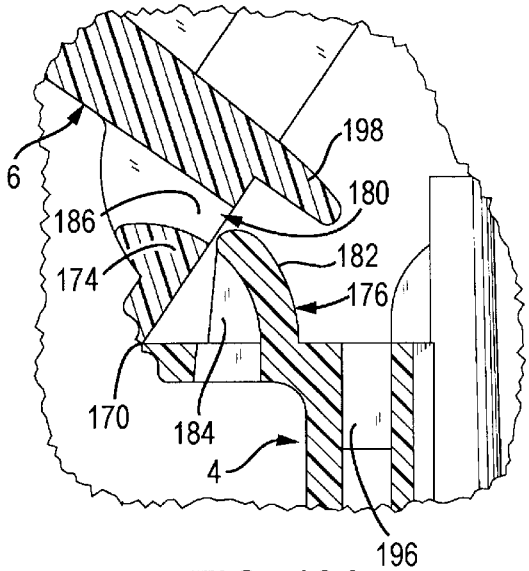
FIGS. 13A–13D show various positions of the progressive latch, as cross-sections through lines 13—13 of FIG. 3.
Figure 13B:
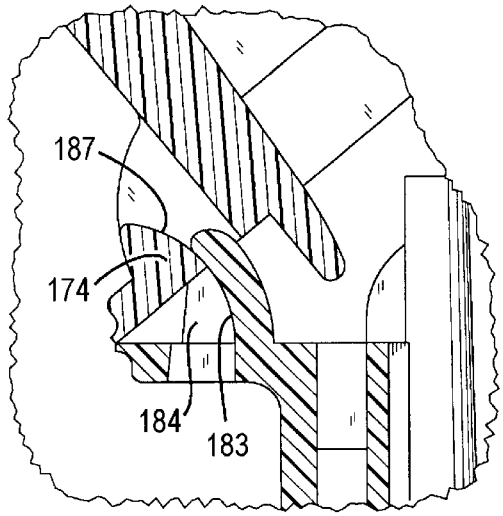
Figure 13C:
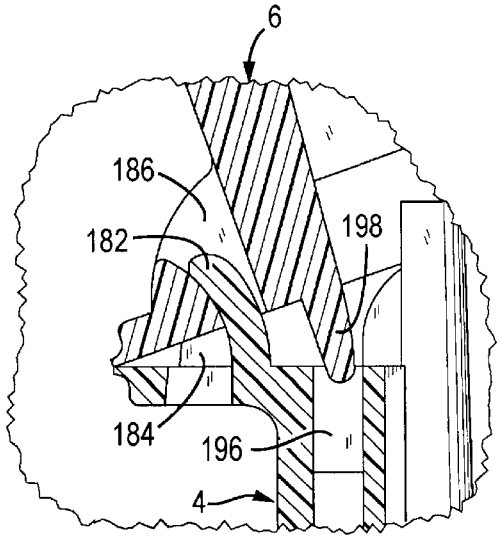
Figure 13D:
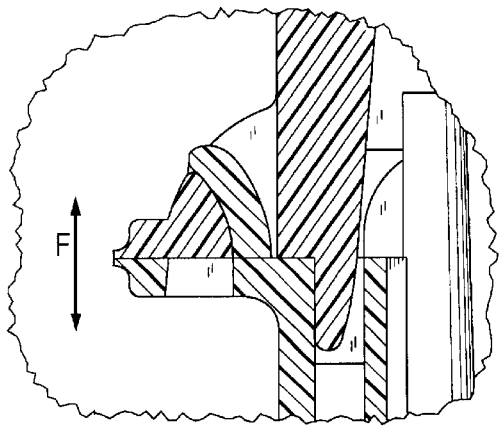

With respect now to FIGS. 13A–13D, the progressive nature of the hinging latch will be described in greater detail. With respect to FIG. 13A, the lid portion 6 is rotated clockwise, as viewed in the orientation of either FIG. 1 or 2, such that the lid 6 is rotated about the hinge 170. FIG. 13A shows the position of the lid relative to the base prior to the projection 176 entering the opening 180. At this position, the contact 8 in the lid 6 would not have begun to make contact with the cable shielding. Given the location of the cross sectional view, the portion 188 (FIG. 3) of the T-slot opening 180, cannot be viewed, but rather, is behind the support wall portion 174 as shown in FIGS. 13A and 13B. As viewed in FIG. 13B, the lid 6 is shown in the position where the curved wall portion 182 has first made entry into the elongate portion 186 of the T-slot where the support rib 184 will be positioned in the transverse portion 188 of the T-slot. FIG. 13C shows further rotation of the lid 6 relative to the base 4, where the upstanding wall portion 198 begins entry into its corresponding slot 196. Finally, FIG. 13D shows the closed position of lid 6 relative to base 4. In this position, the corresponding latch members 190, 192 (FIGS. 1) would also be latched together retaining the entire assembly in a closed position.

This progressive hinging structure, as described in FIGS. 13A through 13D prevents any of the shortcomings of prior art connectors. As discussed earlier, without the progressive latching configuration, due to the forces required to properly engage the cables with the corresponding grounding contacts, together with the force required to displace the grease or gel within the enclosure, it is not uncommon that a hinge portion can break, leaving the entire enclosure, both unsealed, as well as not fully connected vis-a-vis the grounding clip.

In the embodiment described herein, the latching projection 176 with this corresponding opening 180 begins to engage while in a position corresponding to FIG. 13B. In particular, this engagement takes place between surface 183 of wall 182, surface 183 being an arcuate surface facing the hinge 170; and surface 187 of opening 186. This engagement takes load off of the hinge (a load such as force F depicted in FIG. 13D, which would tend to separate the housing halves 4, 6 and/or break the hinges 170) preventing the hinge 170 from breaking. This enhanced configuration provides for an easier assembly, as well as preventing the breaking of the hinge and possible misalignment of the base and lid portions 4, 6.

What is claimed is:

1. An electrical connector of the type for interconnecting at least two wires, comprising an enclosure having at least two housing parts hinged together along one side edge thereof, said hinged side edge further comprising a latch assembly comprised of an arcuate projection and a complementary receiving opening, said arcuate projection being spaced from, and having a concave surface facing, said hinged side edge and being freely rotatable into and out of said opening upon rotation of said housing parts, said opening having an arcuate surface for cooperable contact with said concave surface of said arcuate projection, said arcuate projection, when in the closed position, being in cooperable contact with said arcuate surface to remove the load from said hinged side edge.

2. The electrical connector of claim 1, wherein said arcuate projection is profiled as an arcuately shaped wall, which rotates into said opening, progressively transferring load from said hinged side edge to said latch assembly upon closure of said two housing parts.

3. The connector of claim 2, wherein said opening is elongate in a direction parallel with said hinged side edge, and with said arcuate surface contoured to receive said concave surface in sliding contact therewith.

4. The connector of claim 3, wherein said arcuately shaped wall has a rigidifying rib extending from one of said housing parts, interconnecting said concave surface with said one housing part.

5. The connector of claim 4, wherein said elongate opening is T-shaped to include a portion of the opening to receive said rigidifying rib.

6. The connector of claim 3, wherein said connector has at least one conductive contact member positioned in at least one housing part to make electrical contact with a conductor of a cable upon closure, said arcuately shaped wall being profiled to engage said concave surface and remove load from said hinge, prior to said conductive contact making contact with said cable.

7. An electrical connector enclosure having two housing parts hinged together along a first side edge thereof, the housing parts further comprising a latch assembly comprised of an arcuate latching member positioned on a first housing part having an arcuate surface facing said first side edge, which cooperates with a complementary surface on the second housing part, upon relative rotation therebetween, and progressively transferring load from said first side edge to said latch assembly upon closure of said two housing parts.

8. The electrical connector of claim 7, wherein said two housing parts are integrally connected along said first side edge.

9. The electrical connector of claim 8, wherein said arcuate latching member is defined by an arcuately shaped projection, which is slidably received under, and engages against, said complementary surface.

10. The electrical connector of claim 9, wherein said complementary surface is positioned on an opening that cooperates with said projection.

11. The electrical connector of claim 10, wherein said arcuately shaped projection is an elongate wall that curves towards said first side edge.

12. The electrical connector of claim 11, wherein said arcuate shaped projection has a rigidifying rib which extends between said arcuately shaped projection and said housing part.

13. The electrical connector of claim 12, wherein said opening is T-shaped to include an elongate opening portion to receive said arcuately shaped projection and a transverse portion which receives said rib.

14. The electrical connector of claim 13, wherein said assembly is positioned proximate said first side edge, and said connector includes a second snap latch latching assembly on a second side edge opposite said first side.

15. An electrical connector housing, comprising:

two housing parts which rotate relative to each other along a hinged side edge, the two housing parts having an upper face which, when closed, abut each other;

one of said housing parts including an arcuately shaped projection positioned on said upper face proximate to, and extending substantially parallel to, said hinged side edge, said arcuately shaped projection curving towards said hinged side edge and having an arcuate surface facing said hinged side edge; and an opening profiled to receive said arcuately shaped projection and cooperate with said arcuate surface to remove the forces transmitted through said hinged side edge, during closure of said housing parts.

16. The electrical connector of claim 15, wherein said projection is profiled as an arcuately shaped wall, which rotates into said opening.

17. The connector of claim 16, wherein said arcuately shaped wall has a concave surface facing said hinged side edge, and said opening is elongate and has a surface contoured to receive said concave surface.

18. The connector of claim 17, wherein said arcuately shaped wall has a rigidifying rib extending from one of said housing parts, interconnecting said concave surface with said one housing part.

19. The connector of claim 18, wherein said elongate opening is T-shaped to include a portion of the opening to receive said rigidifying rib.

20. The connector of claim 17, wherein said connector has at least one conductive contact member positioned in at least one housing part to make electrical contact with a conductor of a cable upon closure, and the other housing part has a cable receiving section for receiveing said cable, said arcuately shaped wall being profiled to engage said concave surface and beings to transfer load from said hinge, prior to said conductive contact making contact with said cable.

21. An electrical connector of the type for interconnecting at least two wires, comprising an enclosure having at least two housing parts hinged together along one edge thereof, said hinged side edge further comprising a latch assembly comprised of a projection and a complementary receiving opening, said projection being profiled as an arcuately shaped wall having an inner surface facing said hinged side edge, said arcuately shaped wall having a rigidifying rib extending from one of said housing parts, interconnecting said inner surface with said one housing part, said opening being elongate and having a surface contoured to receive said inner surface of said projection, rotating into said opening upon closure of said housing parts, retaining the two housing parts together.

22. The connector of claim 21, wherein said elongate opening is T-shaped to include a portion of the opening to receive said rigidifying rib.

* * * * *